US010524977B2

(12) United States Patent
Lee

(10) Patent No.: US 10,524,977 B2
(45) Date of Patent: Jan. 7, 2020

(54) FLEXIBLE STIMULATION DEVICE

(71) Applicant: American Latex Corp., Chatsworth, CA (US)

(72) Inventor: Calvin Spencer Lee, Northridge, CA (US)

(73) Assignee: American Latex Corp., Chatsworth, CA (US)

( * ) Notice: Subject to any disclaimer, the term of this patent is extended or adjusted under 35 U.S.C. 154(b) by 0 days.

(21) Appl. No.: 16/214,932

(22) Filed: Dec. 10, 2018

(65) Prior Publication Data

US 2019/0175440 A1 Jun. 13, 2019

Related U.S. Application Data

(60) Provisional application No. 62/596,276, filed on Dec. 8, 2017.

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 23/0263* (2013.01); *A61H 2201/0169* (2013.01); *A61H 2201/0192* (2013.01); *A61H 2201/169* (2013.01); *A61H 2201/1678* (2013.01); *A61H 2201/5025* (2013.01); *A61H 2201/5035* (2013.01); *A61H 2201/5058* (2013.01)

(58) Field of Classification Search
CPC ..... A61H 19/00; A61H 19/30; A61H 19/34; A61H 19/40; A61H 19/44; A61H 19/50; A61H 23/02
See application file for complete search history.

(56) References Cited

U.S. PATENT DOCUMENTS 5,690,603 A 11/1997 Kain
7,081,087 B2 7/2006 Jannuzzi
(Continued)

FOREIGN PATENT DOCUMENTS

CN 102743276 B 9/2014
CN 104758166 A 7/2015
WO 2017173670 A1 10/2017

OTHER PUBLICATIONS

The International Search Report and the Written Opinion of the International Searching Authority for International Application No. PCT/US2018/064746, 28 pages.

*Primary Examiner* — Carrie R Dorna
(74) *Attorney, Agent, or Firm* — Danton K. Mak; Christopher J. Owens

(57) ABSTRACT

Flexible stimulation devices are disclosed that allow for angular motion of the distal portion for enhanced pleasure. The devices include a base portion and a distal portion connected by flexible elastic connection portion. The flexible elastic connection portion is positioned between the handle and the distal portion of the stimulation device to allow for an increased angular range of motion of the distal portion and to reduce or eliminate the transmission of vibration from the distal portion to the base portion. The angular range of motion of the distal portion of the flexible stimulation device enables the user to experience enhanced labial, clitoral, penetrative or "G" spot stimulation depending on their desired use.

13 Claims, 10 Drawing Sheets

(56) References Cited

U.S. PATENT DOCUMENTS

| | | | | |
|---|---|---|---|---|
| 8,622,890 | B1 * | 1/2014 | Caggiano | A61H 19/34 600/38 |
| 9,119,763 | B1 | 9/2015 | Leary | |
| 2005/0273024 | A1 | 12/2005 | Nan | |
| 2008/0009775 | A1 * | 1/2008 | Murison | A61H 19/34 601/46 |
| 2008/0139980 | A1 | 6/2008 | Fladl et al. | |
| 2009/0234182 | A1 * | 9/2009 | Buchholz | A61H 19/44 600/38 |
| 2010/0174135 | A1 | 7/2010 | Shim | |
| 2011/0034763 | A1 * | 2/2011 | Domnick | A61H 19/34 600/38 |
| 2014/0188017 | A1 * | 7/2014 | Wu | A61H 19/40 601/46 |
| 2014/0357944 | A1 * | 12/2014 | Spietz | A61H 19/40 600/38 |

* cited by examiner

FLEXIBLE STIMULATION DEVICE

CROSS-REFERENCE TO RELATED APPLICATION

This application claims the benefit of U.S. Provisional Patent Application Ser. No. 62/596,276, filed on Dec. 8, 2017, which is incorporated herein by reference.

FIELD OF THE INVENTION

This invention relates to sexual stimulation devices, and more particularly to sexual stimulation devices comprising a flexible elastic connection portion positioned between the base portion and the distal portion of the stimulation device.

BACKGROUND INFORMATION

Some conventional sexual stimulation devices allow for the device to be manipulated into different configurations. However, the devices are often malleable and do not return to their original shape after use. In addition, sexual stimulation devices often contain a motor to provide a vibrating function for enhanced stimulation. However, conventional stimulation devices only provide weak vibration that do not provide the user with the desired level of pleasure. Attempts to provide stronger vibration generates increased vibration in the handle of the device that causes the user to experience discomfort. A need exists for a stimulation device that provides the user with an enhanced level of pleasure without leading to discomfort grasping the device.

SUMMARY OF THE INVENTION

The present invention provides a flexible stimulation device that allows for angular motion of the distal portion for enhanced pleasure. The devices include a base portion and a distal portion connected by a flexible elastic connection portion. The flexible elastic connection portion is positioned between the base portion and the distal portion of the stimulation device to allow for an increased angular range of motion of the distal portion and to reduce or eliminate the transmission of vibration from the distal portion to the base portion. The angular range of motion of the distal portion of the flexible stimulation device enables the user to experience enhanced labial, clitoral, penetrative or "G" spot stimulation depending on their desired use.

An aspect of the present invention is to provide a flexible stimulation device, comprising a first device end, a base portion having a first base end adjacent to the first device end and a second base end, a second device end, a distal portion extending from the second device end toward the second base end, and at least one flexible elastic connection portion between the second base end and the distal portion.

Another aspect of the present invention is to provide a flexible stimulation device, comprising a first device end, a base portion having a first base end adjacent to the first device end and a second base end comprising a rigid casing and an internal cavity, a second device end, a distal portion extending from the second device end toward the second base end comprising a rigid casing and an internal cavity, and at least one vibration damping flexible elastic connection portion engaged in the internal cavity of the base portion and the internal cavity of the distal portion.

These and other aspects of the present invention will be more apparent from the following description.

BRIEF DESCRIPTION OF THE DRAWINGS

FIG. 5 shows the side to side angular range of motion of the distal portion of the flexible stimulation device. FIG. 6 shows the front to rear angular range of motion of the distal portion of the flexible stimulation device.

DETAILED DESCRIPTION

Figure 1:
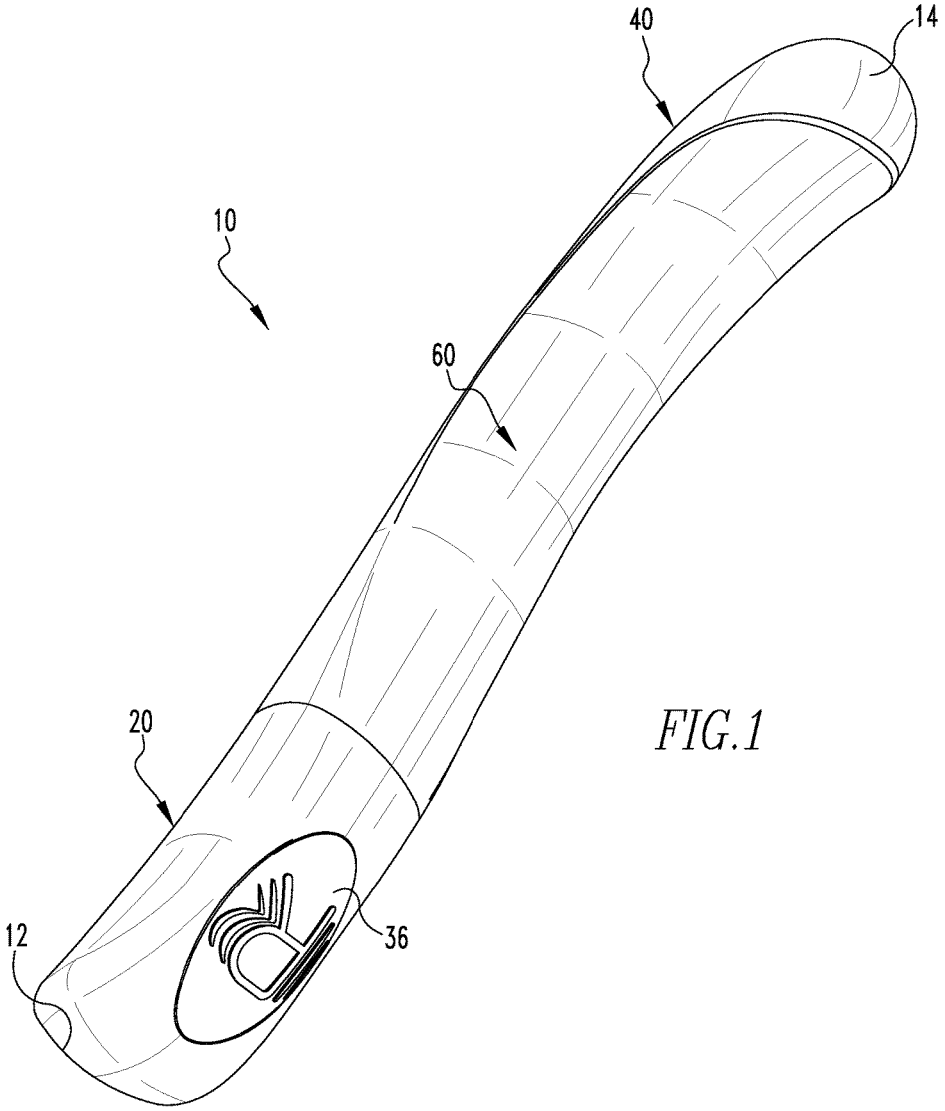
FIG. 1 is an isometric view of a flexible stimulation device in accordance with an embodiment of the present invention.
Figure 4:
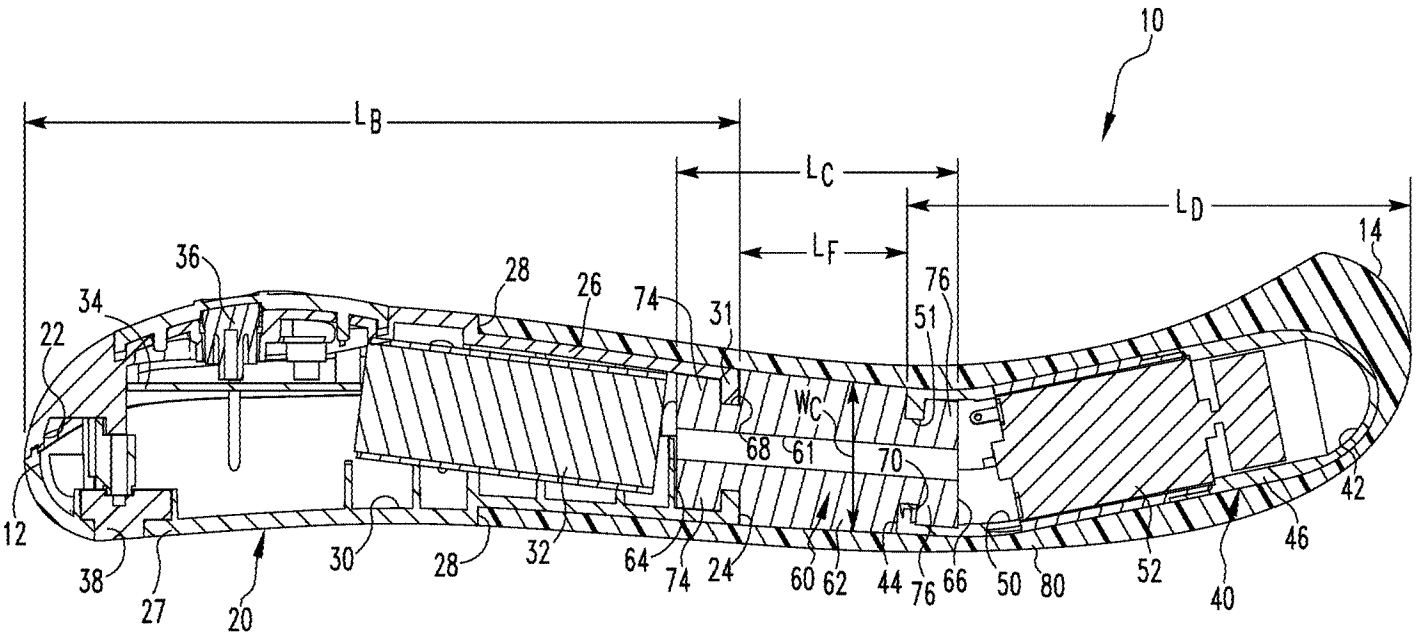
FIG. 4 is a side sectional view of the flexible stimulation device taken through line 4-4 of FIG. 3.

FIG. 1 illustrates a flexible stimulation device 10 in accordance with an embodiment of the present invention. As shown in FIG. 1, the flexible stimulation device 10 has an axial rearward, or first device end 12 and an axial forward, or second device end 14. In accordance with an embodiment of the present invention, the flexible stimulation device 10 includes a base portion 20, a distal portion 40 and a flexible elastic connection portion 60 therebetween. The base portion 20 has a first base end 22 adjacent to the first device end 12 and a second base end 24, as shown in FIG. 4. The distal portion 40 has a distal end 42 adjacent to the second device end 14 and a proximal end 44.

As shown in FIGS. 1-4, the base portion 20 of the flexible stimulation device 10 comprises a casing 26 and an internal cavity 30 structured and arranged to retain an electronic module comprising a power supply 32 and a control module 34. In the embodiment shown, the casing 26 is rigid and nondeformable. As shown in FIG. 4, the internal cavity 30 of the base portion 20 may include a flexible connection engagement protrusion 31 at the second base end 24. In accordance with an embodiment of the present invention, the casing 26 may comprise a shoulder 28 between the first base end 22 and the second base end 24. In the embodiment shown, the shoulder 28 is closer to the second base end 24 than to the first base end 22. In accordance with an embodiment of the present invention, a portion of the base portion 20 between the first device end 22 and the shoulder 28 may form a handle 27 by which the flexible stimulation device 10 can be grasped. In accordance with an embodiment of the present invention, the handle 27 of the base portion 20 may comprise a control button 36 extending from the handle 27 and a charging port 38. However, any other suitable arrangement and location of the control button and the charging port may be used. For example, the base portion 20 may be provided without a control button and/or a charging port, the control button and/or the charging port may be provided on the first device end, or the like.

As shown in FIGS. 1-4, the distal portion 40 of the flexible stimulation device 10 comprises a casing 46 and an internal cavity 50 structured and arranged to retain a vibrating motor 52. In the embodiment shown, the casing 46 is rigid and nondeformable. As shown in FIG. 4, the internal cavity 50 of the base portion 40 may include a flexible connection engagement protrusion 51 at the proximal end 44.

As shown in FIG. 4, a single flexible elastic connection portion 60 may be provided between the base portion 20 and the distal portion 40. The flexible connection portion 60 comprises a body 62, a first end 64 adjacent to the second base end 24 of the base portion 20 and a second end 66 adjacent to the proximal end 44 of the distal portion 40. In accordance with an embodiment of the present invention, the flexible connection portion 60 comprises a central longitudinal bore 61 that allows electrical wiring (not shown) to pass through the flexible connection portion 60. In accordance with an embodiment of the present invention, the wiring allows the power supply 32 and the control module 34 of the base portion 20 to be in electrical communication with the vibrating motor 52 of the distal portion 40. In the embodiment shown, the flexible connection portion 60 is substantially cylindrical, however, any other suitable shape may be used, e.g., rectangular, triangular, hexagonal, D-shaped or the like. In accordance with an embodiment of the present invention, the first end 64 of the flexible connection portion 60 is structured and arranged to engage with the second base end 24 of the base portion 20 and the second end 66 of the flexible connection portion 60 is structured and arranged to engage with the distal end 44 of the distal portion 40. As shown in FIG. 4, the first end 64 of the flexible connection portion 60 is structured and arranged to engage with the flexible connection engagement protrusion 31 of the base portion 20 and the second end 66 of the flexible connection portion 60 is structured and arranged to engage with the flexible connection engagement protrusion 51 of the distal portion 40 In the embodiment shown, the flexible connection portion 60 comprises a first radial channel 68 recessed in the body 62 forming a base portion engagement tab 74 adjacent to the first end 64 and a second radial channel 70 recessed in the body 62 forming a distal portion engagement tab 76 adjacent to the second end 66. In accordance with an embodiment of the present invention, the first radial channel 68 of the flexible connection portion 60 may be structured and arranged engage with the flexible connection engagement protrusion 31 of the base portion 20 and the second radial channel 70 of the flexible connection portion 60 may be structured and arranged to engage with the flexible connection engagement protrusion 51 of the distal portion 40. In the embodiment shown, the first and second radial channels 68 and 70 are square. However, any other suitable shape may be used, e.g., circular, triangular, ovular, rectangular or the like. In accordance with another embodiment of the present invention, the flexible connection portion 60 may be secured to the base portion 20 and the distal portion 40 by any suitable means, e.g., press fitting, adhesives, mechanical fasteners or the like.

In accordance with an embodiment of the present invention, the flexible connection portion 60 allows the distal portion 40 of the flexible stimulation device 10 to bend at any desired angle during use. Bending may be caused by force applied by the user as opposed to an active bending mechanism contained within the flexible stimulation device 10. This results in the user being able to use the device in any desired position for enhanced pleasure. In accordance with an embodiment of the present invention, the flexible connection portion 60 allows for the distal portion 40 to elastically return to its original position after use. The ability for the flexible stimulation device 10 to return or reset to its original shape is provided by selecting a material for the flexible connection portion 60 that is resilient and elastic. Furthermore, the use of a soft, resilient material results in the reduction of the vibration in the base portion 20 caused by the vibrating motor 52 in the distal portion 40, as more fully described below. This allows the user to experience more comfort when holding the flexible stimulation device 10 during use.

As shown in FIG. 4, the base portion 20, the distal portion 40 and the flexible connection portion 60 are each provided as separate components that are secured together. Alternatively, the base portion 20, the distal portion 40 and the flexible connection portion 60 may be integrally formed to provide the flexible stimulation device 10. In accordance with an embodiment of the present invention, the flexible connection portion 60 allows for the vibration amplitude of the distal portion 40 to be increased. Increasing the vibration amplitude of the distal portion 40 may enable the user to experience enhanced labial, clitoral, penetrative or "G" spot stimulation.

In accordance with an embodiment of the present invention, the flexible connection portion 60 provided between the base portion 20 and the distal portion 40 provides a vibration damping effect. In accordance with an embodiment of the present invention, the flexible connection portion 60 reduces or eliminates the transmission of vibration from the distal portion 40 to the base portion 20. In accordance with an embodiment of the present invention, the flexible connection portion 60 reduces or eliminates the noise generated by the vibration of the vibrating motor 52 in the distal portion 40.

Figure 3:
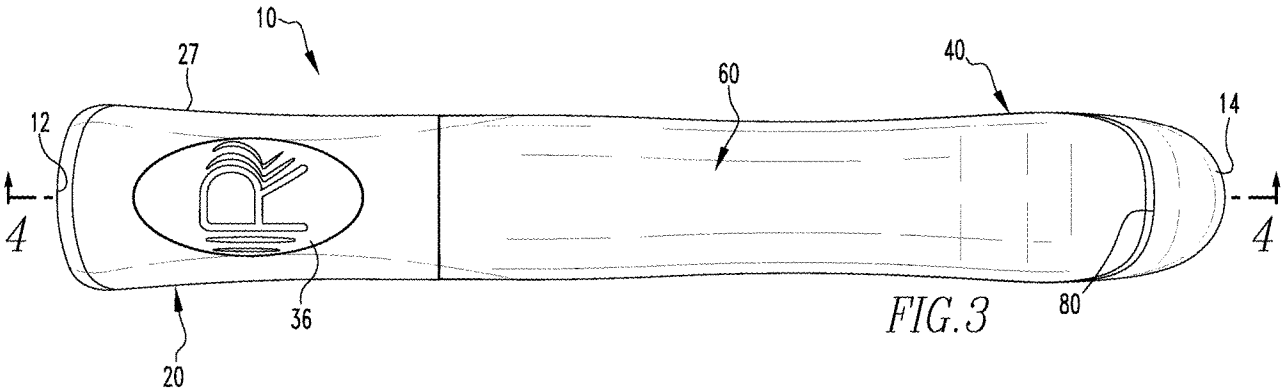
FIG. 3 is a front view of the flexible stimulation device of FIG. 1.
Figure 2:
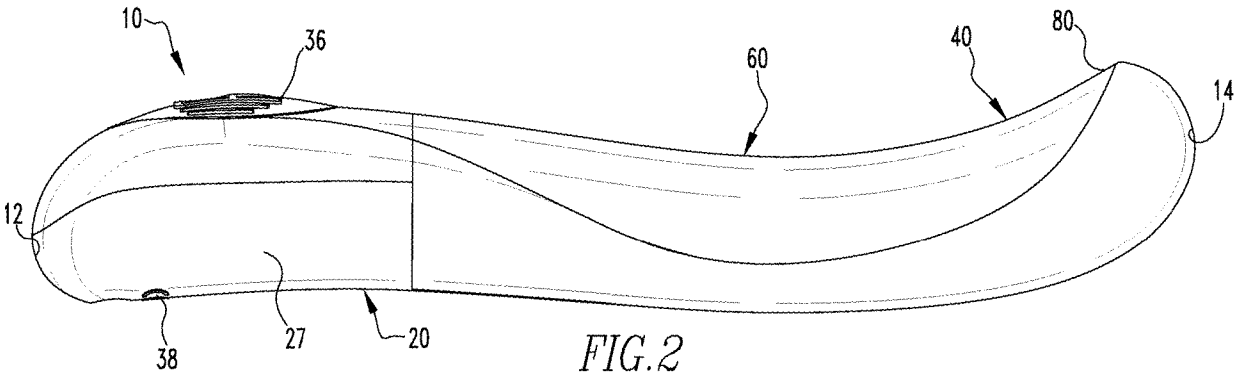
FIG. 2 is a side view of the flexible stimulation device of FIG. 1.

As shown in FIGS. 2-4, the flexible stimulation device 10 is sized for enhanced comfort and stimulation. In accordance with an embodiment of the present invention, the overall flexible stimulation device length from the first device end 12 to the second device end 14 may be selected based upon the user. For example, the overall the flexible stimulation device length may typically range from 4 to 18 inches, or from 6 to 14 inches, or from 8 to 12 inches. As shown in FIG. 4, the base portion 20 has a length $L_B$ selected to retain the electrical components and to allow users to be able to comfortably grasp the device 10. For example, the base portion 20 length $L_B$ may typically range from 1 to 10 inches, or from 2 to 8 inches, or from 3 to 6 inches. The distal portion 40 has a length $L_D$ selected to provide an insertable length that may enable penetrative and "G" spot stimulation. For example, the distal portion 40 length $L_D$ may typically range from 1 to 8 inches, or from 1.5 to 6 inches, or from 2.5 to 5 inches. In certain embodiments, the base portion 20 length $L_B$ is greater than or equal to the distal portion 40 length $L_D$. For example, the ratio of the base portion 20 length $L_B$ to the distal portion 40 length $L_D$ may be from 1:1 to 3:1, for example from 1.2:1 to 2:1. The diameter of the distal portion 40 may be varied to provide comfort and stimulation for a wide range of users. For example, the diameter of the distal portion 40 may range from 0.5 to 2.5 inches, or from 0.75 to 2 inches, or from 1 to 1.5 inches.

As shown in FIG. 4, the flexible connection portion 60 has a total length $L_C$, a flexible length $L_F$ and a width $W_C$. The total length $L_C$ of the flexible connection portion 60 from the first end 64 to the second end 66 may be selected to provide the engagement tabs 74 and 76 and a suitable flexible length $L_F$. In accordance with embodiment of the present invention, the engagement tabs 74 and 76 allow the first and second ends 64 and 66 of the flexible connection portion 60 to be secured in the internal cavity 30 of base portion 20 and the internal cavity 50 of distal portion 40, respectively. For example, the total length $L_C$ of the flexible connection portion 60 may typically range from 0.5 to 4 inches, or from 0.75 to 3 inches, or from 1 to 2 inches. The flexible length LE of the flexible connection portion 60 from the second base end 24 of the base portion 20 to the proximal end 44 of the distal portion 40 may be selected to provide the distal portion 40 with the desired angular range of motion while maintaining its elasticity. For example, the flexible length LE of the flexible connection portion 60 may typically range from 0.25 to 3 inches, or from 0.5 to 2 inches, or from 0.75 to 1.25 inches. In accordance with an embodiment of the present invention, the flexible length LE of the flexible connection portion 60 is at least 10 percent of the overall flexible stimulation device length. For example, the flexible length LE of the flexible connection portion 60 is at least 15 percent, or at least 20 percent, or at least 25 percent, or at least 33 percent of the overall flexible stimulation device length. The width $W_C$ of the flexible connection portion 60 may be selected to allow the distal portion 40 to elastically return after the force is removed. The ratio of the width $W_C$ to the flexible length $L_F$ may be from 5:1 to 1:5, or from 3:1 to 1:3, or from 1.5:1 to 1:1.5. In a particular embodiment, the ratio of the width $W_C$ to the flexible length LE may about 1:1.

In accordance with an embodiment of the present invention, the distal portion 40 length $L_D$ is greater than the flexible length LE of the flexible connection portion 60, e.g., at least 150 percent greater. For example, the ratio of the distal portion 40 length $L_D$ to the flexible length $L_F$ may be from 8:1 to 1:1, or from 6:1 to 1.5:1, or from 4:1 to 2:1, or about 3:1. In accordance with an embodiment of the present invention, the base portion 20 length $L_B$ is greater than the flexible length LE of the flexible connection portion 60, e.g., at least 200 percent greater. For example, the ratio of the base portion 20 length $L_B$ to the flexible length $L_F$ may be from 10:1 to 1:1, or from 8:1 to 2:1, or from 5.5:1 to 3.5:1, or about 4.5:1. In a particular embodiment, the overall flexible stimulation device length may be about 9 inches, the base portion 20 length $L_B$ may be about 4.5 inches, the distal portion 40 length $L_D$ may be about 3 inches, the total length $L_C$ of the flexible connection portion 60 may be about 1.5 inches, the flexible length LE of the flexible connection portion 60 may be about 1 inch, and the width $W_C$ of the flexible connection portion 60 may be about 1 inch.

Figure 5:
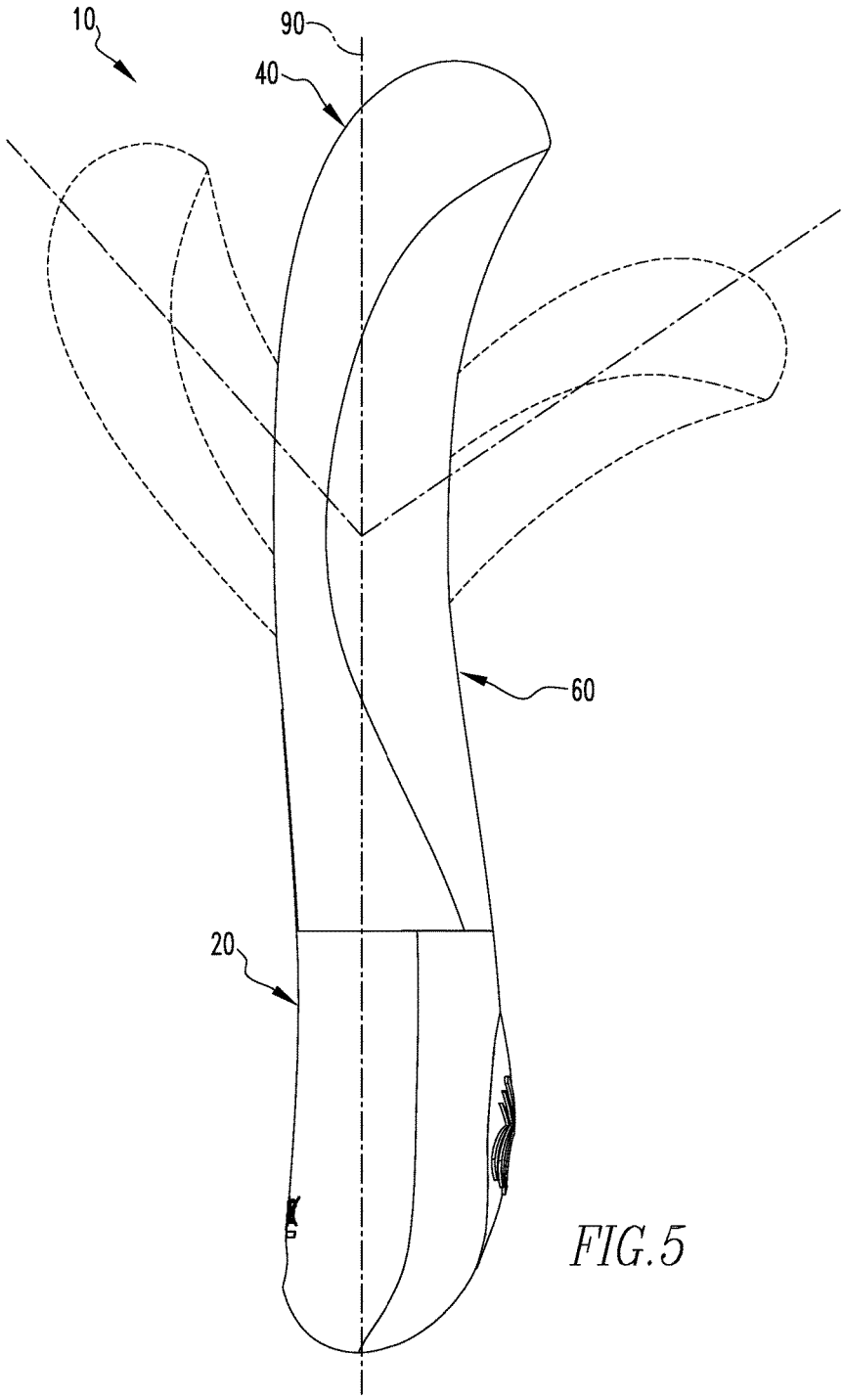
FIGS. 5 and 6 are partially schematic views of the angular range of motion of a distal portion of the flexible stimulation device in accordance with an embodiment of the present invention.
Figure 6:
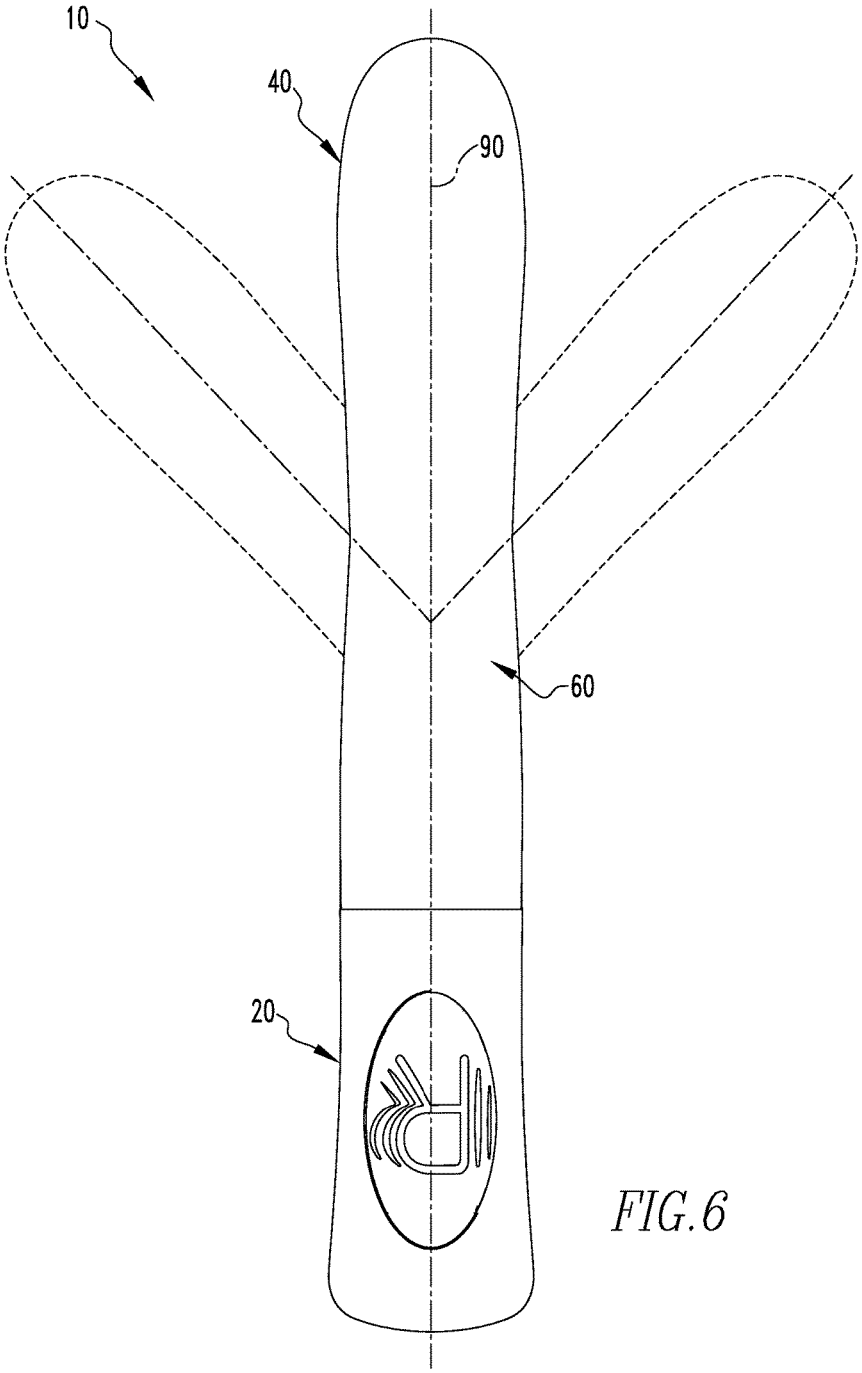

As shown in FIGS. 5 and 6, the flexible stimulation device 10 defines a longitudinal axis 90. In accordance with an embodiment of the present invention, the flexible connection portion 60 of the stimulation device allows for the distal portion to have an angular range of motion from the longitudinal axis of the stimulation device 10. For example, the angular range of motion may typically range from 5 to 60 degrees, or from 10 to 50 degrees, or from 15 to 45 degrees. The angular range of motion may occur in any direction from the longitudinal axis. The angular range of motion provided by the flexible connection portion 60 accommodates the wishes of the user and results in increased pleasure. The angular range of motion of the distal portion of the flexible stimulation device enables the user to experience enhanced labial, clitoral, penetrative or "G" spot stimulation depending on their desired use.

In the embodiment shown in FIGS. 1-6, the flexible stimulation device 10 comprises a single flexible connection portion 60 provided between the base portion 20 and the distal portion 40. However, any other suitable number and arrangement of flexible connection portions 60 may be used. For example, there may be two, three, four or more flexible connection portions.

Figure 12:
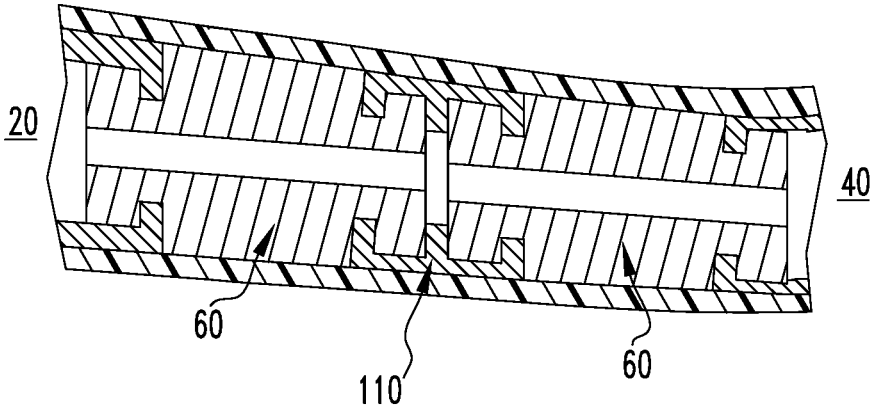
FIG. 12 is a partially schematic side sectional view of the flexible stimulation device in accordance with another embodiment of the present invention.

As shown in the embodiment of FIG. 12, the flexible stimulation device 10 includes two flexible connection portions 60. Multiple flexible connection portions may allow for the flexible stimulation device to flex in different directions during use. In accordance with an embodiment of the present invention, the additional flexible connection portions 60 may be connected by rigid intermediate portions 110, as shown in FIG. 12. The flexible connection portions 60 may engage with the intermediate portions 110 as previously described above for the engagement between the flexible connection portion 60 and the base portion 20 and the distal portion 40. Alternatively, a flexible connection portion 60 may engage directly with an adjacent flexible connection portion 60. In accordance with an embodiment of the present invention, the multiple flexible connection portions 60 may be located between the base portion 20 and the distal portion 40. Alternatively, at least one flexible connection portion 60 may be located between the distal end 42 and the proximal end 44 of the distal portion 40 and at least one flexible connection portion 60 may be located between the base portion 20 and the distal portion 40. In accordance with an embodiment of the present invention, each flexible connection portion 60 allows for the flexible stimulation device 10 to return or reset to its original shape after the force is removed.

In accordance with an embodiment of the present invention, the length of the rigid intermediate portions 110 may be varied depending on the desired flexibility of the flexible stimulation device 10. The total length, flexible length and width of each additional flexible connection portion 60 may be the same or similar to the total length $L_C$, a flexible length LE and a width $W_C$ of a single flexible connection portion 60. In the embodiment shown in FIG. 12, each flexible connection portion 60 may be the same or similar size. However, any other suitable arrangement may be used, e.g., the total length $L_C$, flexible length $L_F$ and/or width $W_C$ of a first flexible connection portion 60 may be equal to, greater than or less than the total length, flexible length and/or width of each additional flexible connection portion 60. Alternatively, the total length and flexible length of two or more flexible connection portions together may be the same or similar to a single flexible connection portion 60, as previously discussed above. In accordance with an embodiment of the present invention, the dimensions of each flexible connection portion 60 may be selected to allow for the desired amount of flexibility and elasticity in different areas of the flexible stimulation device 10.

As shown in FIGS. 1-4, the distal portion 40, the flexible connection portion 60 and a length of the base portion 20 may be covered by a flexible outer sleeve 80. In accordance with an embodiment of the present invention, the flexible outer sleeve 80 extends from the shoulder 28 of the base portion 20 and completely covers the flexible connection 60 and the distal portion 40. In accordance with an embodiment of the present invention, the flexible outer sleeve 80 may cover at least 20 percent of the base portion 20, e.g., at least 25 percent or at least 30 percent. As shown in FIGS. 2-4, the shoulder 28 allows the flexible outer sleeve 80 to be even with the handle 27 of the base portion 20. The flexible outer sleeve 80 is configured for enhanced stimulation. As shown in FIGS. 1-4, the flexible outer sleeve 80 comprises an upward curved shape to provide increased "G" spot stimulation. However, any other suitable shape of flexible outer sleeve 80 may be used, e.g., straight, downward curve, complex curve or the like.

In accordance with an embodiment of the present invention, the flexible stimulation device 10 comprises the appropriate wiring or other conductors (not shown) between the vibrating motor 52, the power supply 32, the control module 34 and the control button 36. In accordance with an embodiment of the present invention, the control module 34 may be a printed circuit board (PCB) configured to control the vibrating motor 52. The control module 34 may be preprogrammed for a variety of vibrating patterns to control the direction, frequency, and strength of the vibration of the vibrating motor 52. The vibrating motor 52 may be configured to vibrate with various frequencies and strengths. For example, the vibrating motor 52 may be configured to produce increasing levels of intensity, consistent vibration, pulsing vibration, different wavelengths of vibration or the like.

In accordance with an embodiment of the present invention, the control button 36 may be a "push-on/push-off" power switch used to toggle the different modes of the vibrating motor 52 of flexible stimulation device 10. In accordance with an embodiment of the present invention, the control button 36 may sequentially select a plurality of vibration modes and/or intensities. In accordance with another embodiment of the present invention, the flexible stimulation device 10 may include a "push-on/push-off" power switch and additional buttons (not shown) to select a plurality of vibration modes and/or intensities. In accordance with an embodiment of the present invention, a user may also control the vibrating motor 52 through any other suitable means, e.g., a remote control, proximity sensors, touch controls or the like.

In accordance with an embodiment of the present invention, the vibrating motor 52 may be a high-power DC motor with a load current that may reach more than 1 amp. However, any other suitable type of motor that can provide the desired vibration of the distal portion 40 of the flexible stimulation device 10 may be used. In accordance with an embodiment of the present invention, the vibrating motor 52 may be sized and arranged to be retained within the internal cavity 50 of the distal portion 40.

In accordance with an embodiment of the present invention, the power supply 32 may be a battery. For example, the power supply 32 may be a rechargeable lithium battery, alkaline batteries or the like. However, any other suitable type of power supply may be used. In accordance with an embodiment of the present invention, the power supply 32 may be recharged by receiving electricity through the charging port 38 located in the handle 27 of the base portion 20.

Figure 7:
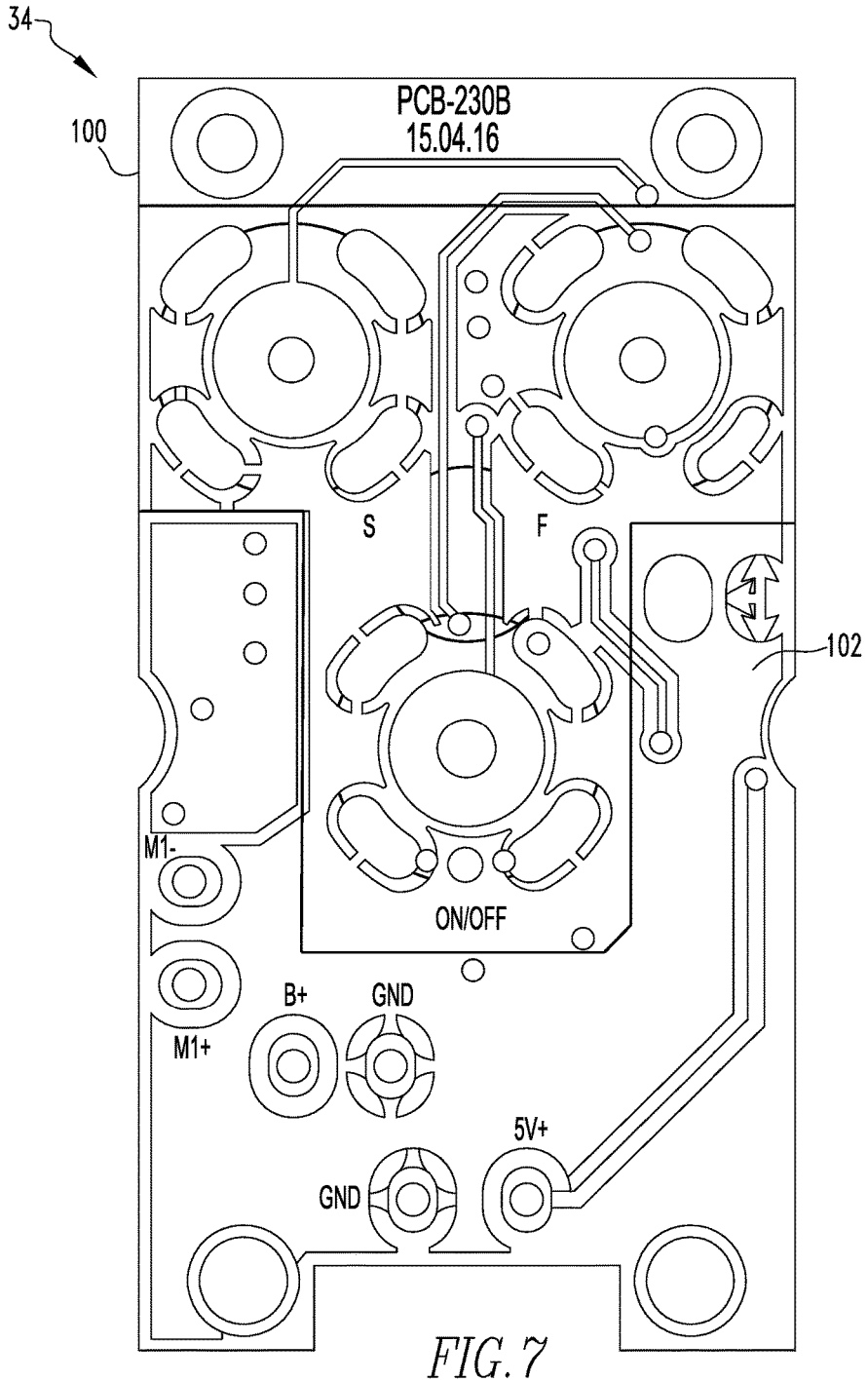
FIG. 7 is a partially schematic diagram of a top layer of a circuit board for the flexible stimulation device in accordance with an embodiment of the invention.
Figure 8:
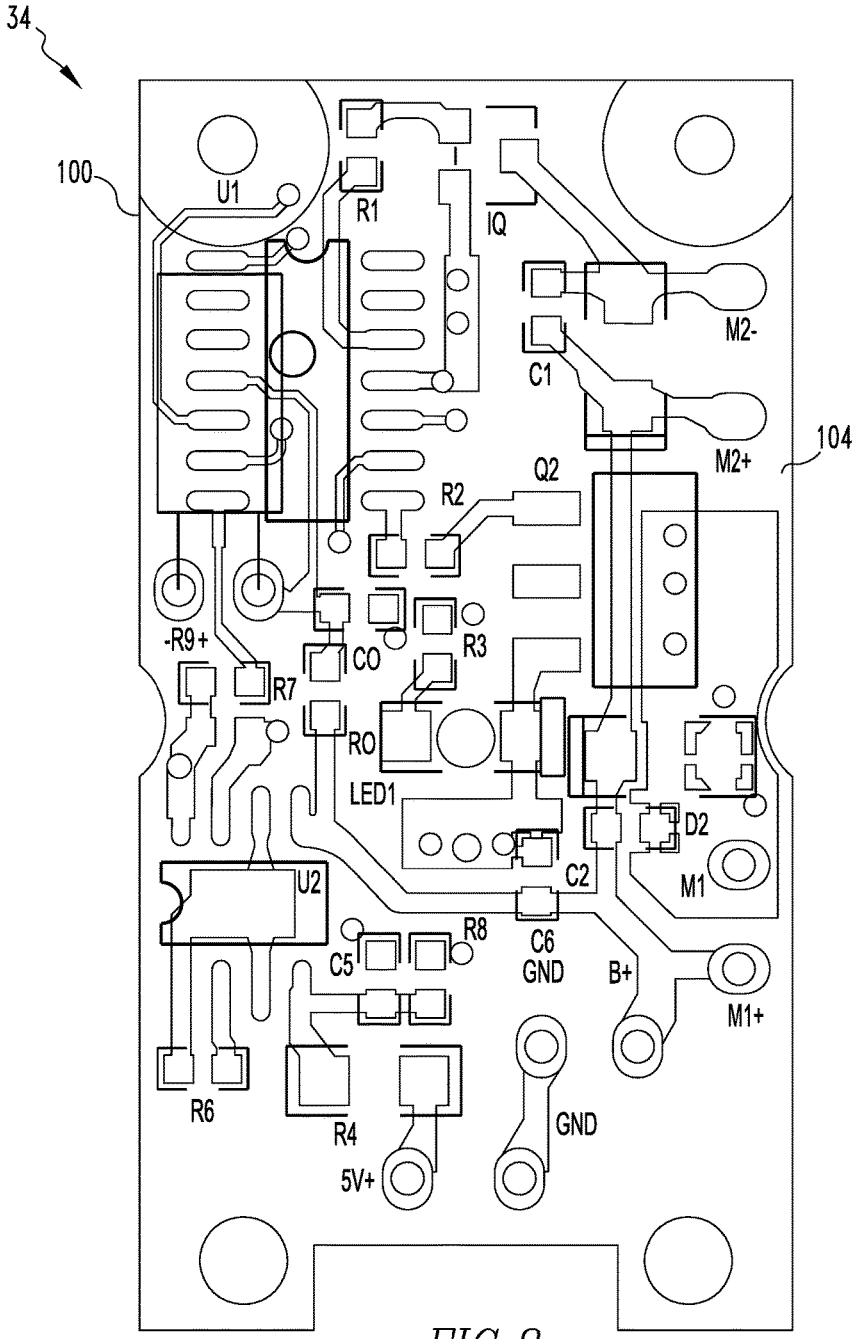
FIG. 8 is a partially schematic diagram of a bottom layer of a circuit board for the flexible stimulation device in accordance with an embodiment of the invention

As shown in FIGS. 7 and 8, the control module 34 may be provided as a printed circuit board 100 comprising a top layer 102 and a bottom layer 104. As shown in FIG. 7, the top layer 102 of the PCB 100 includes a power switch that allows for the vibrating motor to be turned on and off by the control button 36. In embodiment shown, top layer 102 of the PCB includes additional S and F input buttons for the selection of different vibration modes. As shown in FIG. 8, the bottom layer 104 of the PCB 100 includes additional components for controlling the flexible stimulation device 10.

Figure 9:
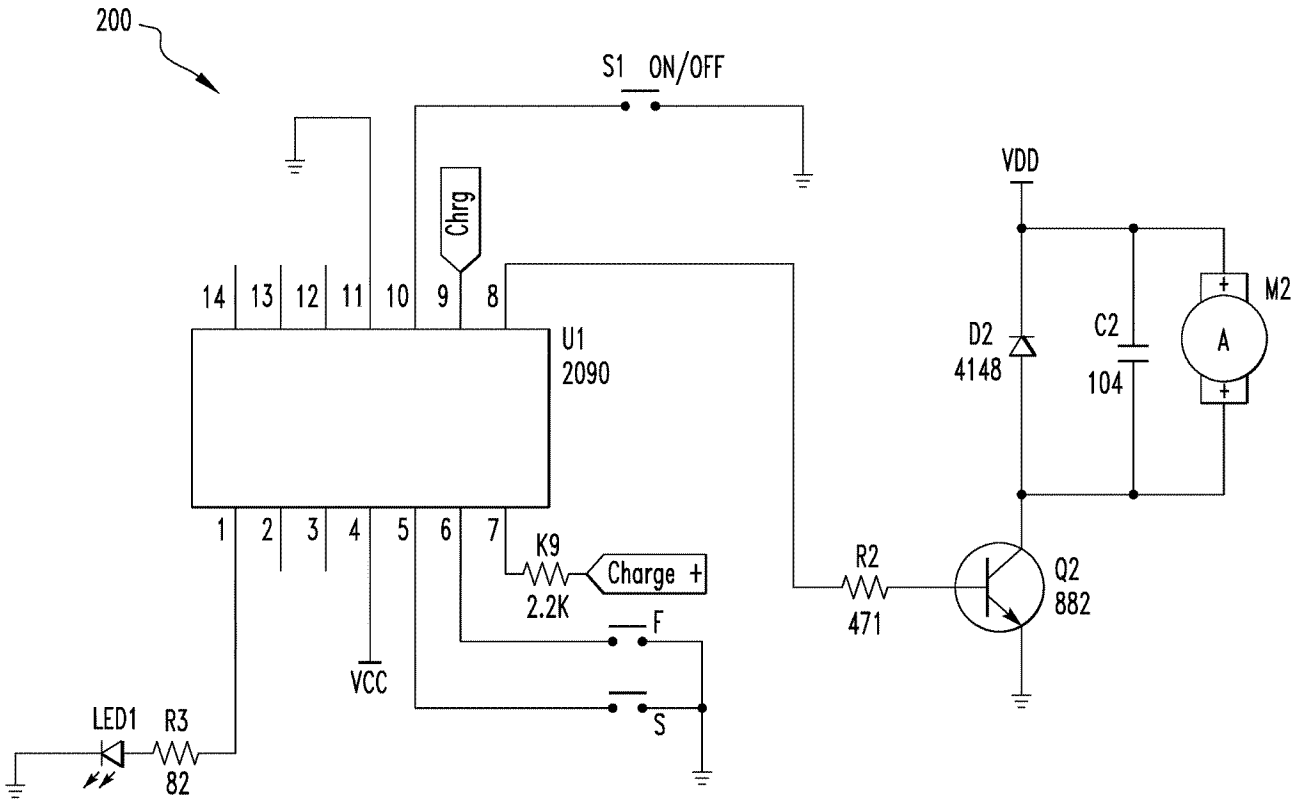
FIGS. 9-11 are schematic diagrams of control circuits for the flexible stimulation device in accordance with an embodiment of the present invention.
Figure 10:
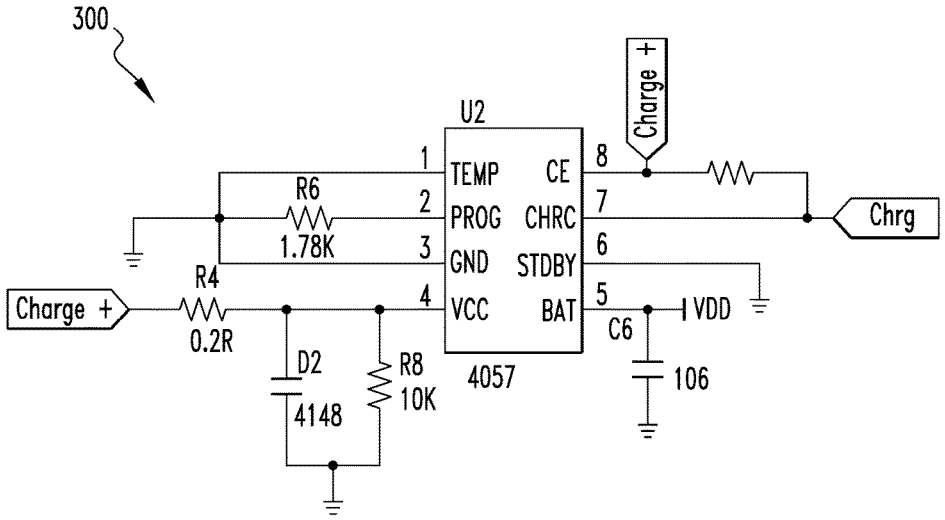
Figure 11:
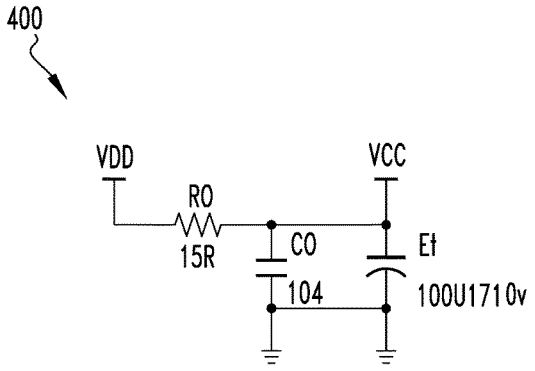

FIGS. 9-11 illustrate exemplary electronic circuit diagrams that may be used to control the operation of a flexible stimulation device 10 in accordance with an embodiment of the present invention. The electrical components are known to those skilled in the art and implement the necessary power and control features according to embodiments of the flexible stimulation device 10. In accordance with another embodiment of the present invention, any other suitable configuration of electrical components may be used. FIG. 9 is a circuit diagram 200 showing the electrical connections between the top layer of the PCB of the control module, the power supply and the vibrating motor in accordance with an embodiment of the present invention. FIG. 10 is a circuit diagram 300 for a charging circuit in accordance with an embodiment of the present invention. FIG. 11 is a circuit diagram 400 for a power supply in accordance with an embodiment of the present invention.

In accordance with an embodiment of the present invention, the flexible connection portion 60 may be made from any suitable resilient elastic material, such as thermoplastic elastomer, thermoplastic rubber, silicone or the like. In accordance with an embodiment of the present invention, the flexible connection portion 60 is substantially free of metal. In accordance with an embodiment of the present invention, the flexible outer sleeve 80 may be made from soft rubber or silicone due to its ability to transmit vibration and stimulation and so that it can be easily cleaned after use.

In accordance with an embodiment of the present invention, the flexible stimulation device 10 may have at least one proximity sensor for controlling vibratory intensities in response the proximity sensor becoming activated by being close to a user's body parts being massaged similar to the proximity sensors disclosed in U.S. Pat. No. 8,308,667 issued Nov. 13, 2012, which is incorporated herein by reference.

For purposes of the description above, it is to be understood that the invention may assume various alternative variations and step sequences except where expressly specified to the contrary. Moreover, other than in any operating examples, or where otherwise indicated, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of"or" means "and/or" unless specifically stated otherwise, even though "and/or" may be explicitly used in certain instances. In this application, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A flexible stimulation device, comprising:

a first device end;

a base portion having a first base end adjacent to the first device end and a second base end comprising a rigid casing and an internal cavity, the base portion comprising a shoulder between the first base end and the second base end;

a second device end;

a distal portion extending from the second device end toward the second base end comprising a rigid casing and an internal cavity;

at least one vibration damping flexible elastic and resilient connection portion engaged in the internal cavity of the base portion and the internal cavity of the distal portion, wherein the vibration damping flexible elastic and resilient connection portion is structured and arranged to elastically return the distal portion to its original position after bending at a desired angle;

a flexible outer sleeve extending from the shoulder of the base portion completely covering the distal portion, the vibration damping flexible elastic and resilient connection portion and a portion of the base portion; and a vibrating motor in the internal cavity of the distal portion structured and arranged to cause vibration of the distal portion, wherein transmission of vibration from the distal portion to the base portion is reduced by a dampening effect of the vibration damping flexible elastic and resilient connection portion.

2. The flexible stimulation device of claim 1, wherein the flexible stimulation device comprises a single one of the vibration damping flexible elastic and resilient connection portions.

3. The flexible stimulation device of claim 1, wherein the at least one vibration damping flexible elastic and resilient connection portion allows the distal portion to comprise an angular range of motion of from 5 to 60 degrees in any direction from a longitudinal axis of the flexible stimulation device.

4. The flexible stimulation device of claim 1, wherein the at least one vibration damping flexible elastic and resilient connection portion is made of a thermoplastic elastomer, thermoplastic rubber or silicone.

5. The flexible stimulation device of claim 1, wherein a length of the base portion is at least 200 percent greater than a flexible length of the at least one vibration damping flexible elastic and resilient connection portion.

6. The flexible stimulation device of claim 1, wherein a length of the distal portion is at least 150 percent greater than a flexible length of the at least one vibration damping flexible elastic and resilient connection portion.

7. The flexible stimulation device of claim 1, wherein the ratio of a width of the at least one vibration damping flexible elastic and resilient connection portion to a flexible length of the at least one vibration damping flexible elastic and resilient connection portion is from 3:1 to 1:3.

8. The flexible stimulation device of claim 1, wherein the at least one vibration damping flexible elastic and resilient connection portion comprises a first radial channel recessed in a body of the at least one vibration damping flexible elastic and resilient connection portion adjacent to a first end and a second radial channel recessed in the body adjacent to the second end, and wherein the first radial channel may be structured and arranged to engage with a flexible connection engagement protrusion of the base portion and the second radial channel may be structured and arranged to engage with a flexible connection engagement protrusion of the distal portion.

9. The flexible stimulation device of claim 1, wherein the base portion further comprises a handle portion adjacent to the first device end.

10. The flexible stimulation device of claim 1, wherein the internal cavity of the base portion retains an electronic module comprising:

a power supply;

a control module; and at least one control button.

11. The flexible stimulation device of claim 10, wherein the electronic module is in electrical communication with the vibrating motor in the distal portion.

12. The flexible stimulation device of claim 10, wherein the at least one control button is structured and arranged to toggle the vibrating motor between off, a first vibration mode, and a second vibration mode.

13. The flexible stimulation device of claim 10, wherein the power supply is a rechargeable battery.

* * * * *